US005167069A

United States Patent [19]

Quinn

[11] Patent Number: 5,167,069

[45] Date of Patent: Dec. 1, 1992

[54] RAZOR REACH

[76] Inventor: Kathleen H. Quinn, 1615 Ansonborough Dr., Chesterfield, Mo. 63017

[21] Appl. No.: 360,720

[22] Filed: Jun. 2, 1989

[51] Int. Cl.[5] ..... B26B 21/14

[52] U.S. Cl. ..... 30/89; 30/87

[58] Field of Search ..... 30/32, 41, 85, 87–89

[56] References Cited

U.S. PATENT DOCUMENTS

D. 231,050 3/1974 Gray ..... D28/46

D. 260,191 8/1981 Chase et al. ..... D28/46

D. 309,036 7/1990 Cheng ..... D28/46

*Primary Examiner*—Douglas D. Watts

*Attorney, Agent, or Firm*—Rogers, Howell & Haferkamp

[57] ABSTRACT

A razor shaving apparatus is provided having a telescopically extendable and retractable body with a manual handle at one end and a pivoting razor shaving assembly at its opposite end, and having a soap or lotion applicator detachably secured to the razor shaving assembly.

5 Claims, 5 Drawing Sheets

16
24
22
36
46
32
42
48
52
58
44
62
34
14
28

RAZOR REACH

BACKGROUND OF THE INVENTION (1) Field of the Invention

The present invention relates to an extendable razor shaving apparatus. In particular, the present invention relates to a razor shaving apparatus having a telescopically extendable and retractable body with a manual handle at one end and a pivoting razor shaving assembly at its opposite end, and having a soap or lotion applicator detachably secured to the razor shaving assembly.

(2) Description of the Related Art

Prior art safety razors or disposable razors are commonly comprised of a handle having a razor blade carriage mounted at one end. Many prior art safety and disposable razors include disposable blades or disposable blade carriages that are detachably secured to the handle and replaced after a certain period of use.

A disadvantage often encountered with the use of prior art safety and disposable razors is that the limited length of the razor handle requires the user to be able to reach their hand holding the razor to substantially adjacent the area being shaved by the razor. The limited length of conventional razor handles does not extend the reach of the individual much further beyond the reach of their hands. This often presents a problem to women in pregnancy or with physical impairments who, because of their physical condition, find it difficult to bend over and reach the lower areas of their legs.

What is needed to overcome this problem is a razor shaving apparatus having a shaving blade that is extendable to varying distances from the handle of the apparatus. Such an apparatus would enable a user to extend the reach of a shaving blade of the apparatus significantly beyond the reach of their hands.

SUMMARY OF THE INVENTION

The extendable razor shaving apparatus of the present invention is basically comprised of a manual handle, a razor shaving assembly, and a telescoping extension assembly interconnecting the shaving assembly and the handle.

The shaving assembly is basically comprised of a curved support arm and a blade carriage mounting a shaving blade. The carriage is releasably connected to one end of the support arm to enable replacement of the shaving blade after a period of use. The blade carriage is also pivotally connected to the support arm to enable the shaving blade to follow the contours of the skin surface being shaved. The opposite end of the support arm is pivotally connected to a distal end of the extension assembly.

The extension assembly is basically comprised of first and second tubular members that are telescopically interconnected. The shaving assembly is pivotally connected at one end of the extension assembly and the handle assembly is connected at the opposite end of the extension assembly.

The first tubular member is telescopically received inside the second tubular member, and the second tubular member is telescopically received inside the handle assembly to reduce the overall length of the apparatus and position the support arm and blade carriage at their closest adjusted position relative to the apparatus handle. The second tubular member is telescopically extended from the handle, and the first tubular member is telescopically extended from the second tubular member to position the support arm and blade carriage at their furthest adjusted positions from the handle of the apparatus. The first and second tubular members are selectively locked in their extended positions relative to the handle to maintain the apparatus at its longest adjusted length. In a further embodiment of the apparatus, the first and second tubular members are spring biased toward their telescopically extended positions from the apparatus handle.

A soap or lotion applicator is also provided with the apparatus of the invention. The applicator is detachably attached to the support arm of the shaving assembly in a position opposite to that of the blade carriage. The apparatus is employed in applying soap or lotion to areas of the body that are difficult to reach in much the same manner that the apparatus enables the shaving blade to reach areas of the body.

Extending the support arm and blade carriage from the apparatus handle enables a user of the apparatus to reach the shaving blade to areas to be shaved that the user is incapable of reaching with their hands alone. The apparatus can be used with the first, or both the first and second tubular sections telescopically extended from the handle, enabling the user to adjust the overall length of the apparatus to that which is most comfortable for use.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1A:
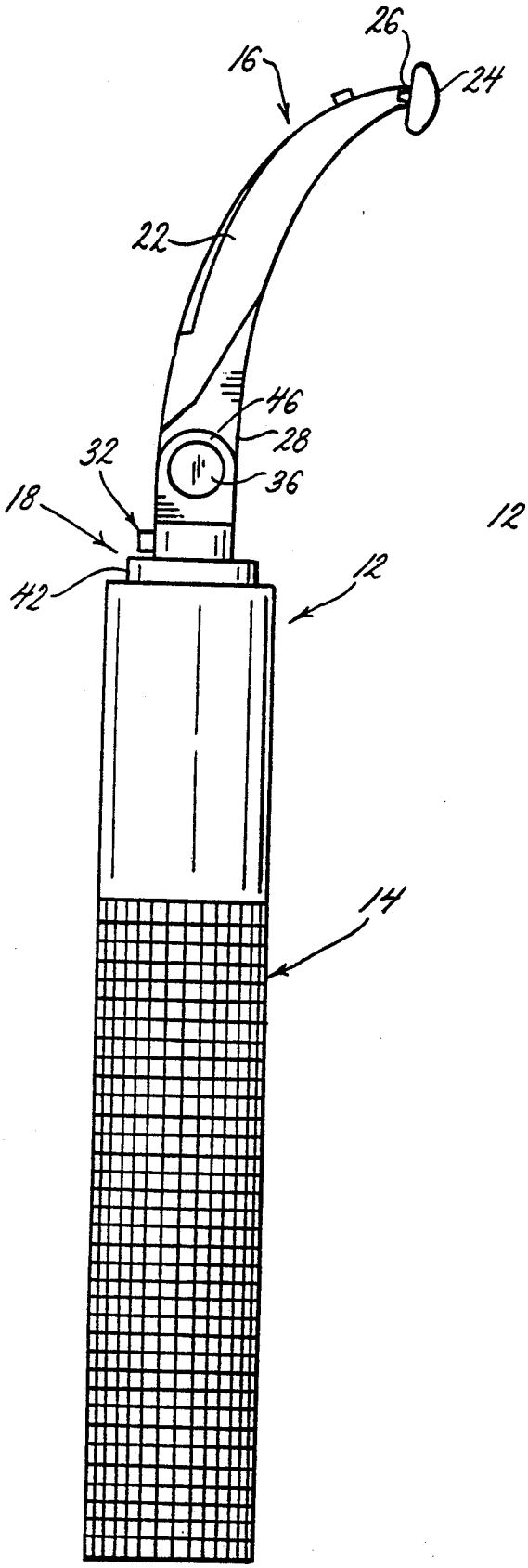
FIG. 1*a* illustrates a side view of the apparatus in its most collapsed position.
Figure 1B:
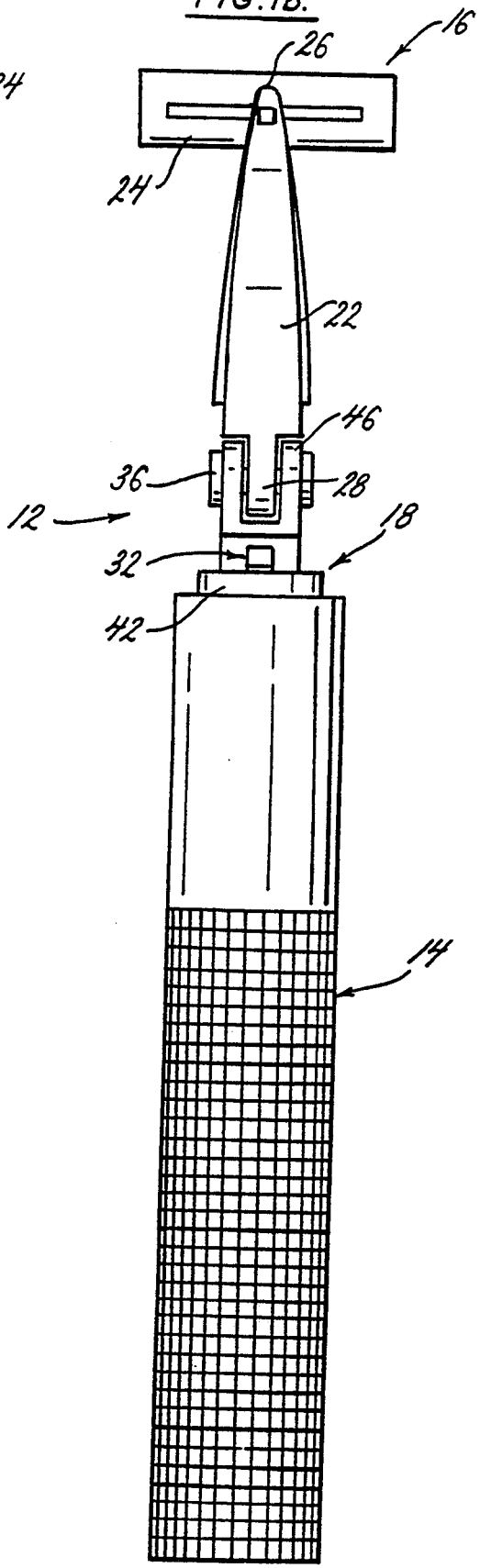
FIG. 1*b* illustrates a rear view of the apparatus in its most collapsed position.
Figure 2A:
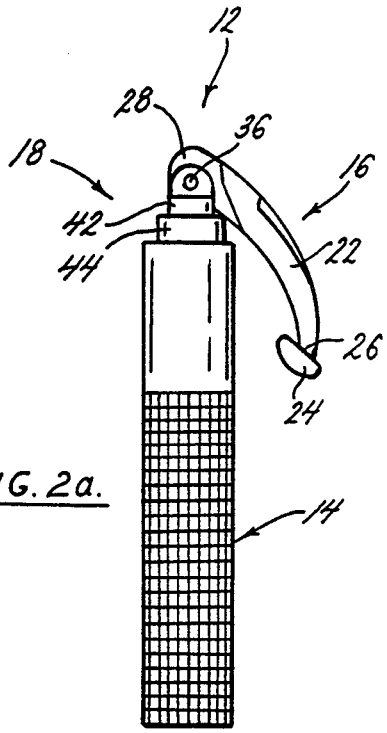
FIG. 2*a* illustrates the apparatus in its most collapsed position with the shaving assembly of the apparatus folded down to its furthest extent.
Figure 2B:
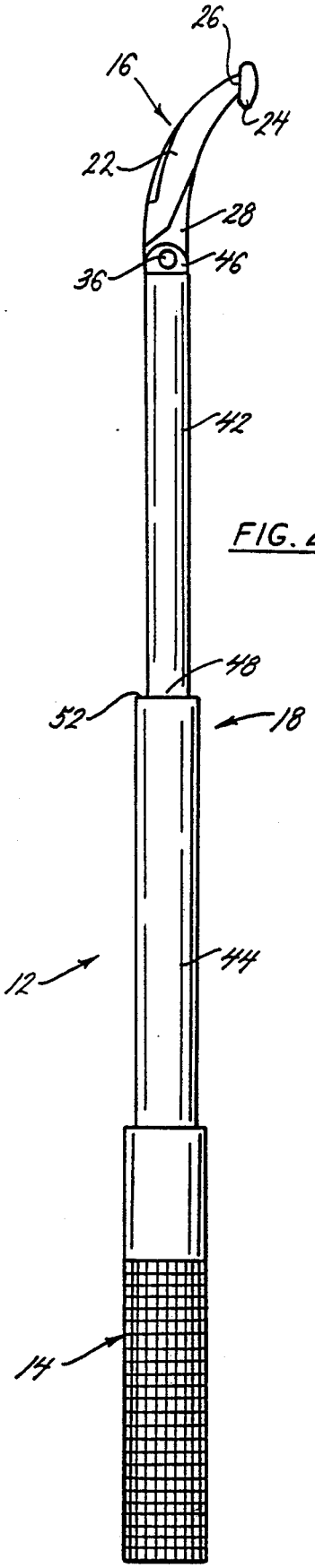
FIG. 2*b* illustrates the apparatus in its most extended position with a schematic representation of the preferred extended distance of 21 inches.

The extendable razor shaving apparatus 12 of the present invention is shown in its retracted condition in FIG. 1*a* and 1*b*, and is shown in its extended condition in FIG. 2*b*. As is best seen in FIG. 2*b*, the apparatus 12 is comprised of a manual handle assembly 14, a razor shaving assembly 16, and a telescoping extension assembly 18 interconnecting the shaving assembly with the handle assembly.

Figures 3A, 3B, 3C:
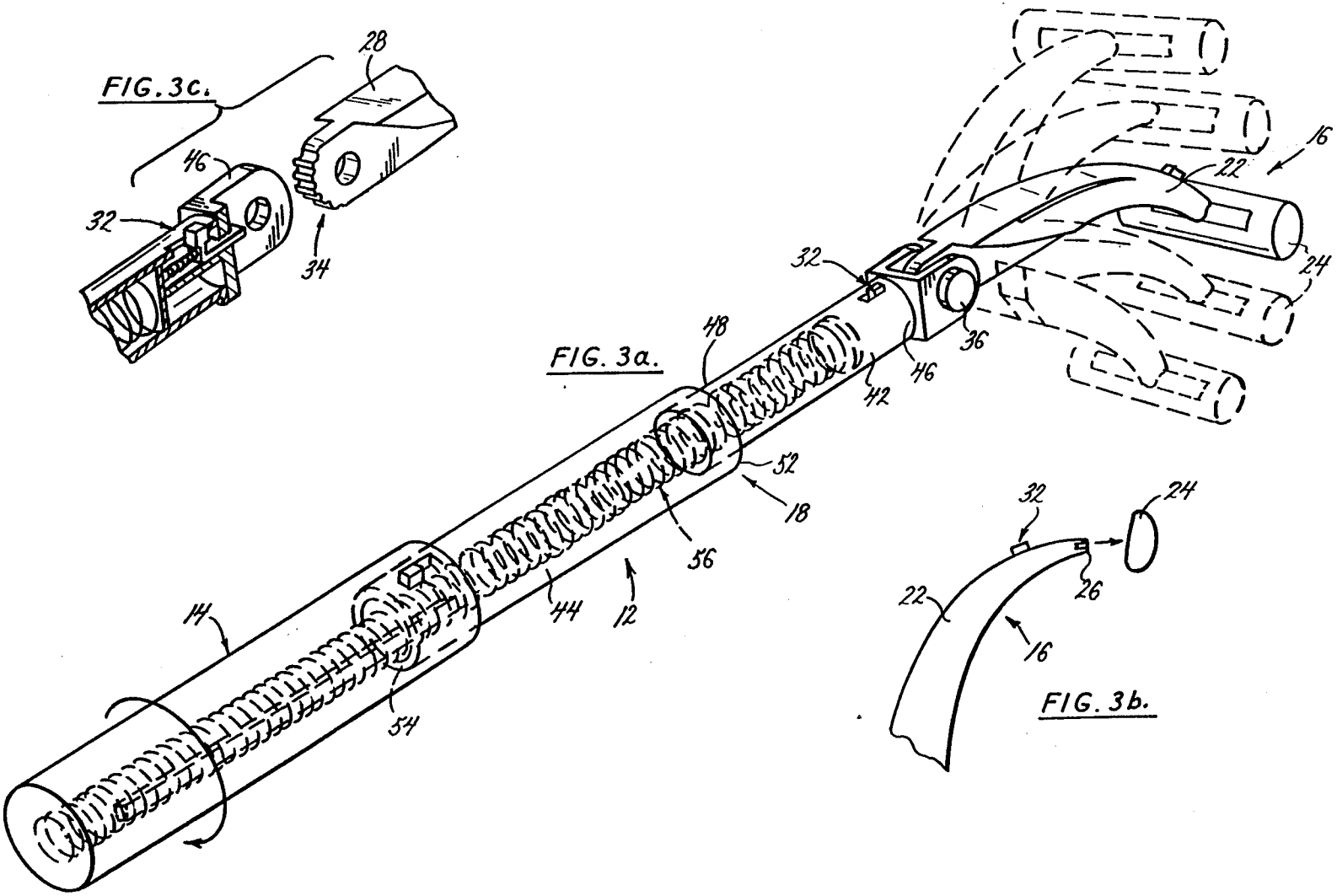
FIG. 3*a* illustrates the apparatus in its most extended position and schematically represents the pivoting adjustment of the shaving assembly of the apparatus.
FIG. 3*b* illustrates the details of the shaving assembly of the apparatus.
FIG. 3*c* illustrates the details of the pivoting connection of the shaving assembly to the extension assembly of the apparatus.
Figures 4A, 4B, 4C, 4D:
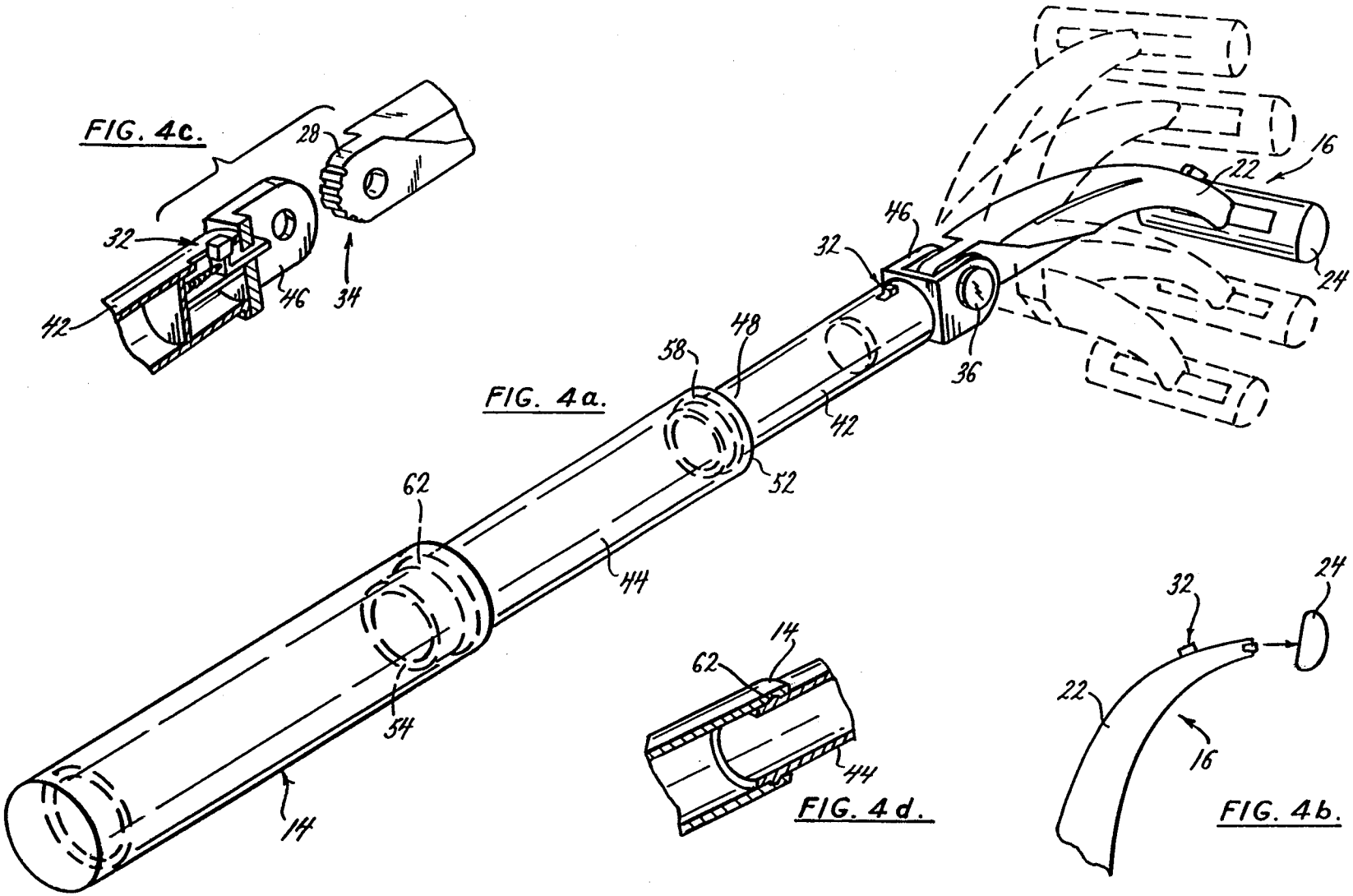
FIG. 4*a* illustrates a further embodiment of the apparatus in its extended position.
FIG. 4*b* illustrates the detail of the shaving assembly of the apparatus of FIG. 4*a;*
FIG. 4*c* illustrates the detail of the pivoting connection between the shaving assembly and the extension assembly of the apparatus of FIG. 4*a;*
FIG. 4*d* illustrates the detail of the connection of the extension assembly to the handle assembly of FIG. 4*a;*

The shaving assembly 16 is best seen in FIG. 1. The assembly is basically comprised of a curved support arm 22 and a blade carriage 24 mounting a shaving razor blade (not shown). As is illustrated in FIGS. 3*b* and 4*b*, the blade carriage 24 is detachable from its connection to the distal end 26 of the support arm 22. This enables the removal of the blade carriage 24 from the support arm 22 after a period of use, and the replacement of a new blade carriage on the distal end 26 of the support arm. The detachable connection of the blade carriage 24 to the distal end of the support arm 26 is also a pivoting connection, enabling the shaving blade (not shown) supported by the blade carriage 24 to follow the contours of the skin surface being shaved by the apparatus.

As is illustrated in FIGS. 3*a* and 4*a*, the proximal end 28 of the support arm 22 is pivotally connected to the distal end of the extension assembly 18. FIGS. 3*c* and 4*c* show the detail of the pivot connection of the support arm 22 to the extension assembly 18. As seen in FIGS. 3*c* and 4*c*, a spring biased detent assembly 32 is provided that engages with a series of notches 34 provided in the proximal end 28 of the support arm to releasably hold the support arm 22 in a variety of adjusted positions relative to the extension assembly 18. FIGS. 3*a* and 4*a* show schematically the range of arcuate pivoting movement of the support arm 22 relative to the extension assembly 18 made possible by the pivot connection 36 of the support arm 22 to the extension assembly 18. In the preferred embodiment of the invention, the shaving assembly 16 is adjustable to six different shaving positions relative to the extension assembly 18 and the handle 14. FIG. 2*a* shows the apparatus in its most compact adjusted position with the support arm 22 of the shaving assembly 16 completely folded over the handle 14 of the apparatus.

Two different embodiments of the extension assembly are shown in FIGS. 3*a* and 4*a*. The embodiment of FIG. 3*a* is comprised of first and second tubular members 42, 44 that are telescopically interconnected. The distal end 46 of the first tubular member 42 is pivotally connected to the proximal end 28 of the shaving assembly support arm 22. The proximal end 48 of the first tubular member is received inside the second tubular member 44 at its distal end 52. The connection between the first tubular member 42 and second tubular member 44 enables the first tubular member to be telescopically received inside the second tubular member. The proximal end 54 of the second tubular member is inserted into the handle assembly 14. The connection between the second tubular member 44 and the handle assembly 14 enables the second tubular member to be telescopically received inside the handle assembly.

The telescoping connections of the first tubular member 42, second tubular member 44, and the handle assembly 14 enable the first and second tubular members to be telescopically received inside the handle assembly, and enable the first and second tubular members to be telescopically extended from the handle assembly. The telescoping connections between the first and second tubular members 42, 44 and the handle assembly 14 enable the apparatus to be extended to three different lengths, depending on the needs of the user. The three different lengths in the preferred embodiment of the invention can be determined from the schematic representation of the overall length of the apparatus of the invention appearing in FIG. 2*b*. As illustrated in FIGS. 1*a* and 1*b*, the first tubular member 42 is telescopically received inside the second tubular member 44, and the second tubular member is telescopically received inside the handle assembly 14 to reduce the overall length of the apparatus and position the support arm 22 and blade carriage 24 in their closest adjusted positions relative to the handle assembly 14. As illustrated in FIGS. 2*b*, 3*a* and 4*a*, the second tubular member 44 is telescopically extended from the handle assembly 14, and the first tubular member 42 is telescopically extended from the second tubular member to position the support arm 22 and blade carriage 24 at their furthest adjusted positions from the handle assembly 14 of the apparatus.

In the embodiment of the invention shown in FIG. 3*a*, the first and second tubular members 42, 44 are spring biased by a coil spring 56 to their telescopically extended positions from the handle assembly 14. The spring 56 is employed to lock the apparatus in its extended condition shown in FIG. 3*a*.

In an alternate embodiment of the invention shown in FIG. 4*a*, non-concentric cams 58, 62 are employed to lock the apparatus in its extended condition in lieu of the coil spring 56 of the embodiment of FIG. 3*a*.

Figure 5A:
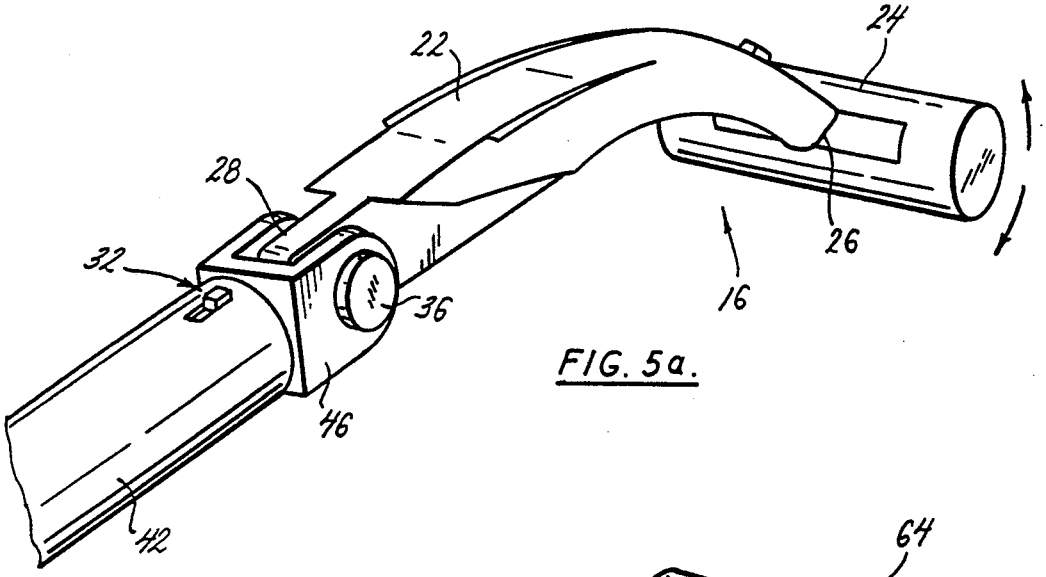
FIG. 5*a* illustrates the pivoting movement of the blade cartridge relative to the support arm of the apparatus.
Figure 5B:
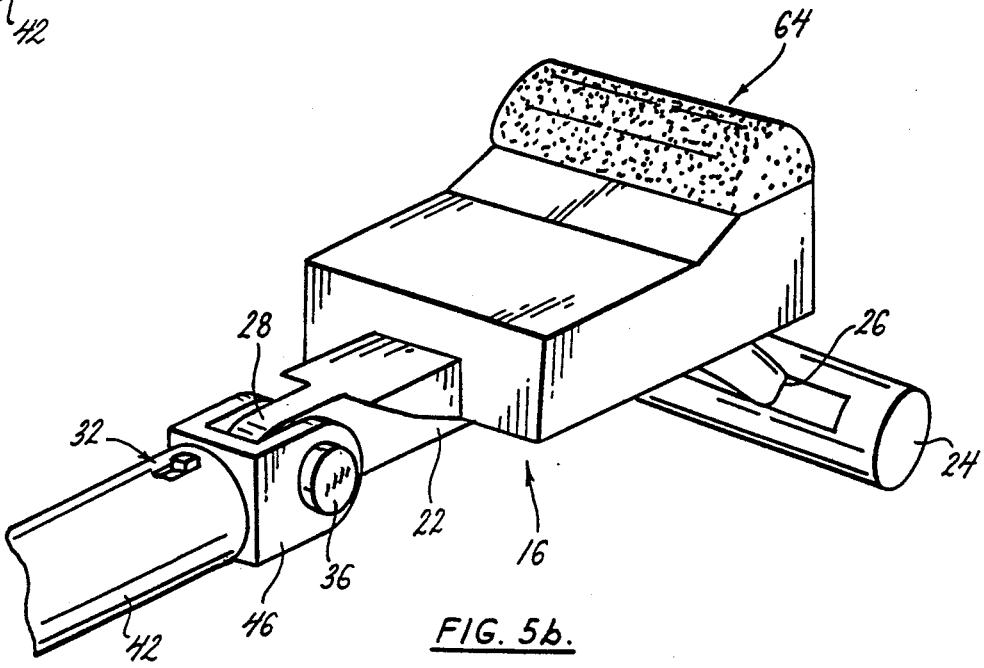
FIG. 5*b* illustrates the liquid applicator of the apparatus releasably attached to the support arm of the apparatus.
Figure 5C:
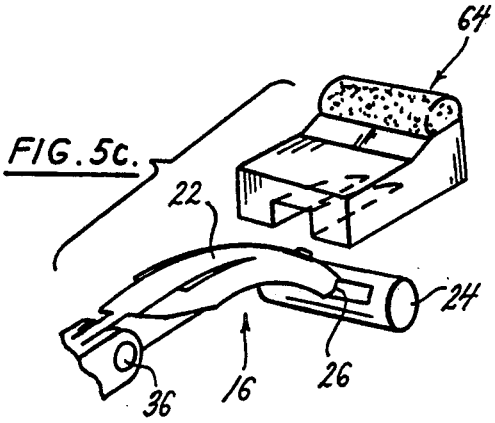
FIG. 5*c* illustrates the applicator detached from the support arm of the apparatus.

A soap or lotion sponge applicator assembly 64 of the apparatus of the invention is shown in FIGS. 5*b* and 5*c*. As seen in FIG. 5*c*, the applicator assembly 64 is detachably attached to the support arm 22 of the shaving assembly 16 in a position opposite to that of the blade carriage 24. The sponge applicator is employed in applying soap, lotion, ointment, or other similar liquids to areas of the body that are difficult to reach in much the same manner as the apparatus enables the shaving blade (not shown) of the blade carriage 24 to reach areas of the body. The sponge applicator is employed to apply and spread these liquids over areas of skin prior to their being shaved.

While the present invention has been described by reference to specific embodiments, it should be understood that modifications and variations of the invention may be constructed without departing from the scope of the invention defined in the following claims.

What is claimed is:

1. A razor shaving apparatus comprising:

a head assembly supporting a shaving blade;

a handle assembly for manually gripping and manipulating the apparatus;

a plurality of extension members connected between the head assembly and the handle assembly, the plurality of extension members being interconnected for movement relative to each other to selectively position the head assembly at a first distance from the handle assembly and to selectively position the head assembly at a second distance from the handle assembly, the second distance being greater than the first distance;

the plurality of extension members includes a first extension member connected to the handle assembly and a second extension member connected to the first extension member and the head assembly, the second extension member being telescopically received in the first extension member and telescopically extendable from the first extension member;

the first and second extension members are telescopically receivable in the handle assembly and are telescopically extendable from the handle assembly; and the first and second extension member are spring biased to their telescopically extended positions from the handle assembly.

2. The apparatus of claim 1, wherein:

the second extension member is lockable in its telescopically extended position relative to the first extension member, and the first extension member is lockable in its telescopically extended position relative to the handle assembly.

3. A razor shaving apparatus comprising:

a head assembly supporting a shaving blade;

a handle assembly for manually gripping and manipulating the apparatus;

a plurality of extension members connected between the head assembly and the handle assembly, the plurality of extension members being interconnected for movement relative to each other to selectively position the head assembly at a first distance from the handle assembly and to selectively position the head assembly at a second distance from the handle assembly, the second distance being greater than the first distance;

the head assembly includes a blade carriage and a support member connected to the blade carriage and the plurality of extension members; and a fluid applicator is detachably connected to the support member, the applicator has an absorbent pad for applying and spreading fluids.

4. The apparatus of claim 3, wherein:

the support member is connected by a pivot connection to one extension member of the plurality of extension members, the pivot connection enabling the support member to pivot through an arch relative to the one extension member.

5. The apparatus of claim 4, wherein:

the support member is connected by a releasable pivot connection to the blade carriage, the releasable pivot connection enables the blade carriage to be pivot relative to the support member and the releasable pivot connection enables the blade carriage to be selectively detached from the support member.

* * * * *